US007358916B2

(12) United States Patent
Milyakh

(10) Patent No.: US 7,358,916 B2
(45) Date of Patent: Apr. 15, 2008

(54) POLARIZATION DIVERSITY ANTENNA SYSTEM

(75) Inventor: Yaroslav Milyakh, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/581,446

(22) Filed: Oct. 17, 2006

(65) Prior Publication Data

US 2007/0097007 A1 May 3, 2007

(30) Foreign Application Priority Data

Nov. 3, 2005 (KR) ..... 10-2005-0104995

(51) Int. Cl.
*H01Q 13/10* (2006.01)

(52) U.S. Cl. ..... 343/770; 343/700 MS

(58) Field of Classification Search ..... 343/770, 343/767, 700 MS, 795
See application file for complete search history.

(56) References Cited

U.S. PATENT DOCUMENTS 4,410,891 A 10/1983 Schaubert et al.
4,547,779 A * 10/1985 Sanford et al. ..... 343/700 MS
5,828,344 A 10/1998 Alder et al.
5,977,929 A 11/1999 Ryken
6,731,245 B1 * 5/2004 Stotler et al. ..... 343/700 MS
6,967,625 B1 * 11/2005 Honda ..... 343/771
2002/0084942 A1 * 7/2002 Tsai et al. ..... 343/795
2003/0020664 A1 1/2003 Thudor et al.
2005/0168389 A1 * 8/2005 Yuanzhu et al. ..... 343/767

FOREIGN PATENT DOCUMENTS

EP 0 762 542 A2 3/1997
EP 1 291 971 A1 3/2003
KR 10-2005-0022846 A 3/2005

* cited by examiner

*Primary Examiner*—Hoanganh Le
(74) *Attorney, Agent, or Firm*—Sughrue Mion, PLLC

(57) ABSTRACT

A polarization diversity antenna system includes antenna elements having first to fourth slotlines bent at right angles so that the second slotline is provided adjacent to the first slotline, the third slotline is diagonally opposite to the first slotline and provided adjacent to the second slotline, and the fourth slotline is provided adjacent to the third slotline and diagonally opposite to the second slotline, and a switching network in which coupling units are formed between ends of the horizontal slotlines and between ends of the vertical slotlines that are close to intersections of the vertical and horizontal slotlines to determine polarization.

10 Claims, 6 Drawing Sheets

POLARIZATION DIVERSITY ANTENNA SYSTEM

CROSS-REFERENCE TO RELATED APPLICATION

This application claims priority from Korean Patent Application No. 10-2005-0104995 filed on Nov. 3, 2005 in the Korean Intellectual Property Office, the disclosure of which is incorporated herein by reference in its entirety.

BACKGROUND OF THE INVENTION

1. Field of the Invention

The present invention relates to polarization diversity in an antenna system and, more particularly, to a polarization diversity antenna which has a simple structure and a small size.

2. Description of the Related Art

In the antenna field, polarization means a polarity direction of an E field with respect to a propagation direction of an electromagnetic wave. Every antenna has polarization of its own, and matching of polarization directions of transmitting and receiving antennas is an important consideration. The polarization can be classified into linear polarization and circular polarization.

Polarization diversity is a technology for improving frequency efficiency in mobile communications using different frequencies of adjacent cell base stations. In this technology, two frequency signals are cross-polarized using a single antenna.

That is to say, two frequency signals which do not interfere with each other and have an orthogonal phase are mixed to be used for the single antenna. In this manner, the same frequency can be reused in the neighboring cell, thus enhancing user capacity.

In related art, a dual-polarization antenna or a mechanically rotating feed line is used to realize the above-mentioned polarization diversity.

However, the former is problematic in that a structure for achieving polarization diversity is very complicated and a large amount of power is consumed, and the latter is problematic in that reliability is reduced due to mechanical breakdown.

U.S. Pat. No. 5,977,929 discloses a structure of a polarization diversity antenna which is shown in FIG. 1.

Referring to FIG. 1, a crossed-dipole antenna includes four antenna elements 12, 14, 16, and 18, and a switching circuit 40.

The switching circuit 40 controls operation of the antenna elements 12, 14, 16, and 18 so as to provide vertical linear polarization and horizontal linear polarization, and acts as a radio frequency (RF) switching element having a plurality of PIN diodes.

Further, the switching circuit 40 has a voltage source 42 for providing direct current (DC) voltage to the switching circuit 40, a pair of DC blocking capacitors C1 and C2, and inductors L1, L2, and L3 blocking a radio frequency signal.

The capacitor C1 is connected to a positive RF signal input terminal 44 and the capacitor C2 is connected to a negative RF signal input terminal 46 to block the DC voltage from the RF signal input terminals 44 and 46.

Capacitors C1 and C2 may have the same value.

In addition, the inductor L1 is connected to the voltage source 42 to block an RF signal from the voltage source 42, and the inductor L3 is connected to a ground to block the RF signal from ground.

If positive bias voltage is applied through the voltage source 42 to the switching circuit 40, PIN diodes D2 and D3 are turned on and PIN diodes D1 and D4 are turned off. Therefore, the RF signal flows through the PIN diodes D2 and D3 of the switching circuit 40 as indicated by arrows 48 in FIG. 1.

Hence, the antenna element 14 is coupled with the antenna element 16 and the antenna element 12 is coupled with the antenna element 18, so that the positive bias DC voltage applied to the switching circuit 40 forms horizontal linear polarization moving from a left side to a right side in FIG. 1.

On the other hand, if negative bias voltage is applied through the voltage source 42 to the switching circuit 40, the PIN diodes D1 and D4 are turned on and the PIN diodes D2 and D3 are turned off. Therefore, the RF signal flows through the PIN diodes D1 and D4 of the switching circuit 40 as indicated by arrows 50 in FIG. 1.

Accordingly, the antenna element 12 is coupled with the antenna element 14 and the antenna element 16 is coupled with the antenna element 18, so that negative bias DC voltage applied to the switching circuit 40 forms vertical linear polarization moving from a lower side to an upper side in FIG. 1.

A terminal of the inductor L2 is connected to anodes of the PIN diodes D1 and D3, and another terminal is connected to cathodes of the PIN diodes D2 and D4. When a bias current is transmitted through the inductor L2, the inductor L2 prevents the RF signal from flowing.

+Vrf which is applied to the terminal 44 and −Vrf which is applied to the terminal 46 denote an RF driving signal for the switching circuit 40. In connection with this, −Vrf has a phase difference of 180° with respect to +Vrf.

The diversity antenna shown in FIG. 1 has a simpler and more efficient structure in comparison with a former antenna.

However, in the diversity antenna, it is necessary to use a bidirectional bias signal to control a switching circuit. This is not a desirable solution since most RF devices have a single unipolar power source. Furthermore, there is a problem in that the antenna cannot be operated without bias voltage.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

According to aspects of the present invention there is provided a polarization diversity antenna system that is simplified, small, and low cost.

Aspects of the present invention are not limited to those mentioned above, and other aspects of the present invention will be understood by those skilled in the art through the following description.

Aspects of the present invention provide a polarization diversity antenna system which may include antenna elements including first to fourth slotlines bent at right angles so that the second slotline is provided adjacent to the first slotline, the third slotline is diagonally opposite to the first slotline and adjacent to the second slotline, and the fourth slotline is provided adjacent to the third slotline and diagonally opposite to the second slotline, and a switching network in which coupling units are formed between ends of the horizontal slotlines and between ends of the vertical slotlines that are close to intersections of the vertical and horizontal slotlines to determine polarization.

BRIEF DESCRIPTION OF THE DRAWINGS

The above and other aspects of the present invention will become more apparent by describing in detail exemplary embodiments thereof with reference to the attached drawings, in which.

DESCRIPTION OF THE EXEMPLARY EMBODIMENTS

Aspects of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims.

Figure 1:
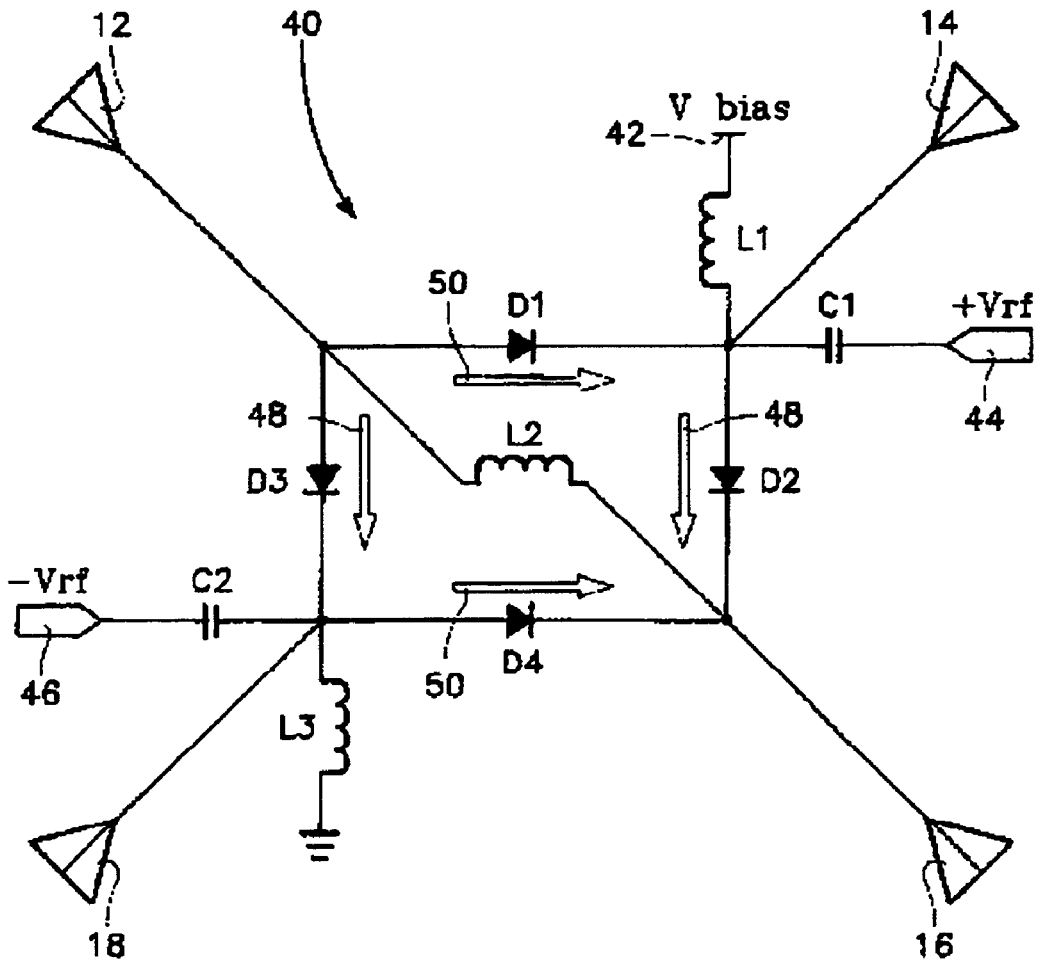
FIG. 1 illustrates a structure of a conventional polarization diversity antenna.
Figure 2:
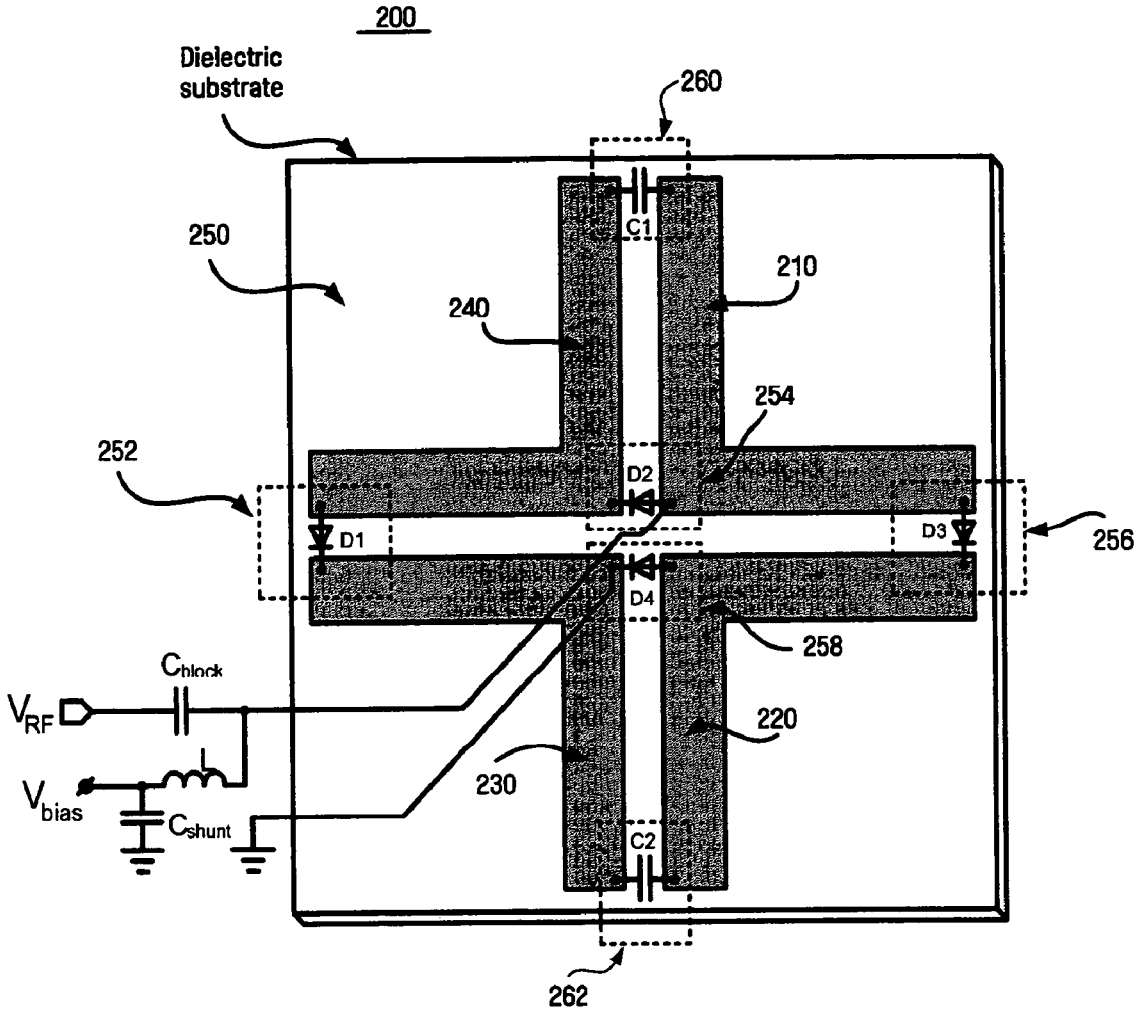
FIG. 2 illustrates a structure of a polarization diversity antenna system according to an exemplary embodiment of the invention.

FIG. 2 illustrates a structure of a polarization diversity antenna system according to an exemplary embodiment of the invention.

With reference to FIG. 2, a polarization diversity antenna system 200 includes antenna elements 210, 220, 230, and 240, and a switching network 250.

In connection with this, the antenna elements 210, 220, 230, and 240 are formed of half wavelength slotlines, and the slotline constituting each antenna element is bent at a right angle.

Furthermore, the switching network 250 is a unit for coupling the antenna elements 210, 220, 230, and 240, and the coupling unit may be exemplified by a PIN diode.

The PIN diodes are provided on ends of the horizontally extending slotlines, and on ends of the vertically extending slotlines that are close to the intersection of the vertically and horizontally extending slotlines. In FIG. 2, the former diodes are designated by 252 and 256, and the latter diodes are designated by 254 and 258.

Figure 3:
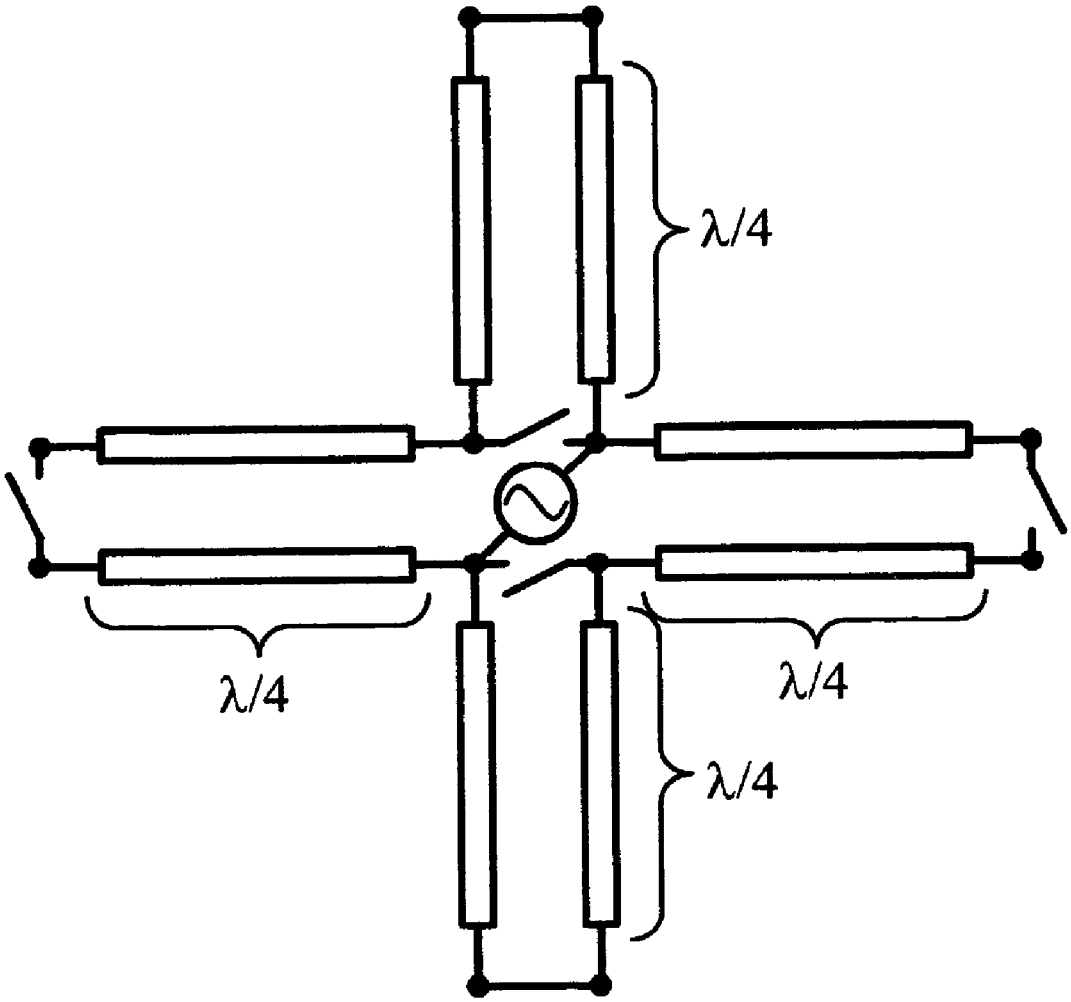
FIG. 3 illustrates an RF equivalent circuit of the polarization diversity antenna system shown in FIG. 2.

Capacitors 260 and 262 are formed on other ends of the vertical slotlines to be short circuited for an RF signal and to be an open circuit for a low frequency bias current. FIG. 3 illustrates an RF equivalent circuit for the polarization diversity antenna system shown in FIG. 2.

Figure 4:
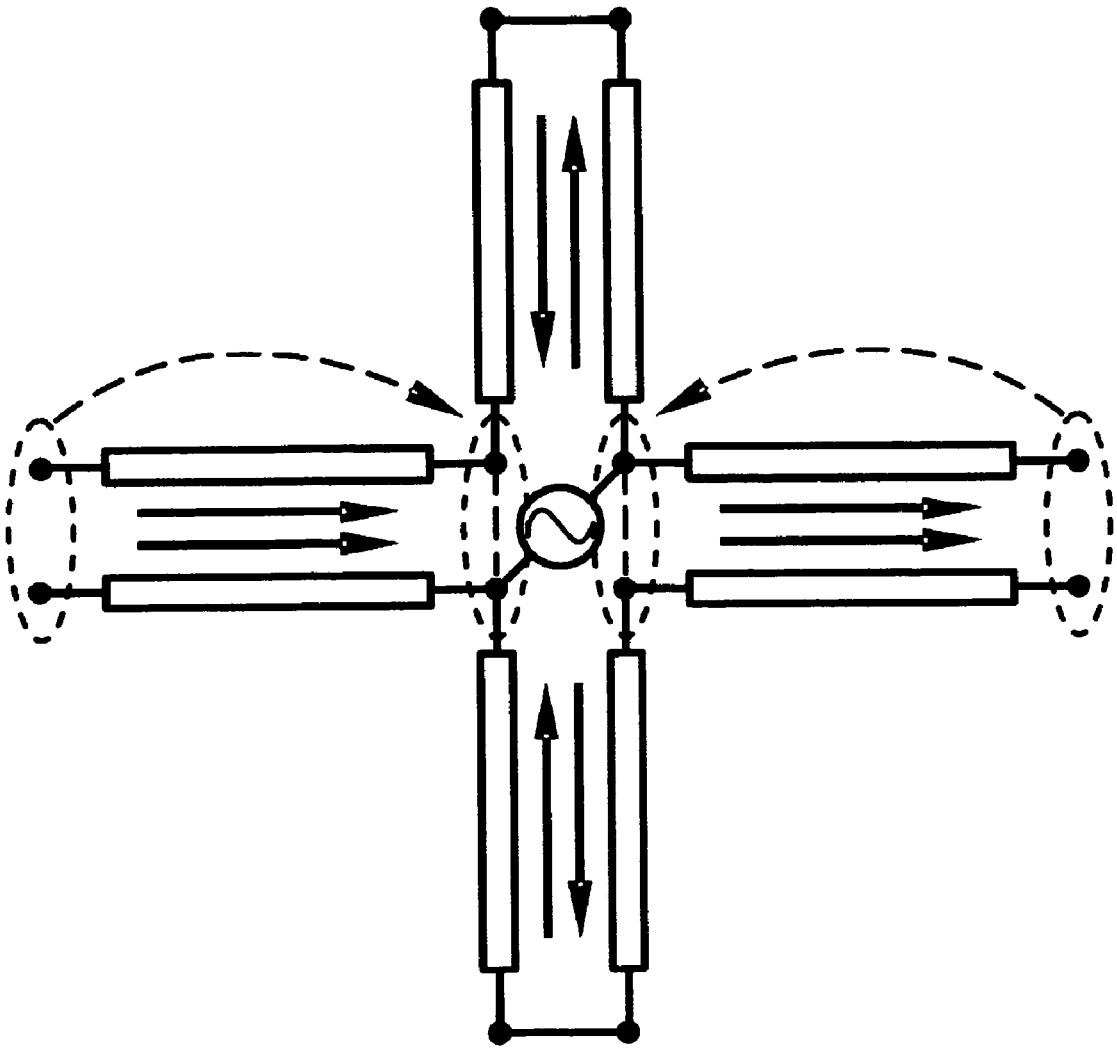
FIG. 4 illustrates the RF equivalent circuit when polarization is formed in a horizontal direction according to the exemplary embodiment of the invention.

FIG. 4 illustrates the RF equivalent circuit when polarization is formed in a horizontal direction according to the exemplary embodiment of the invention.

If bias voltage of zero volts is applied to the switching network 250, all the PIN diodes are closed. That is to say, the switches are disconnected as shown in FIG. 3.

An open circuit in the ends of the horizontal slotlines is transformed into a short circuit over a quarter wavelength at the intersection of the slotlines as shown in FIG. 4.

Accordingly, in-phase linear polarization is formed in a horizontal direction.

Also, the vertical slotlines are closed for the RF signal at the ends thereof, and act as a quarter wavelength short circuited stub. The vertical slotlines are opposite in phase to each other and do not radiate.

Figure 5:
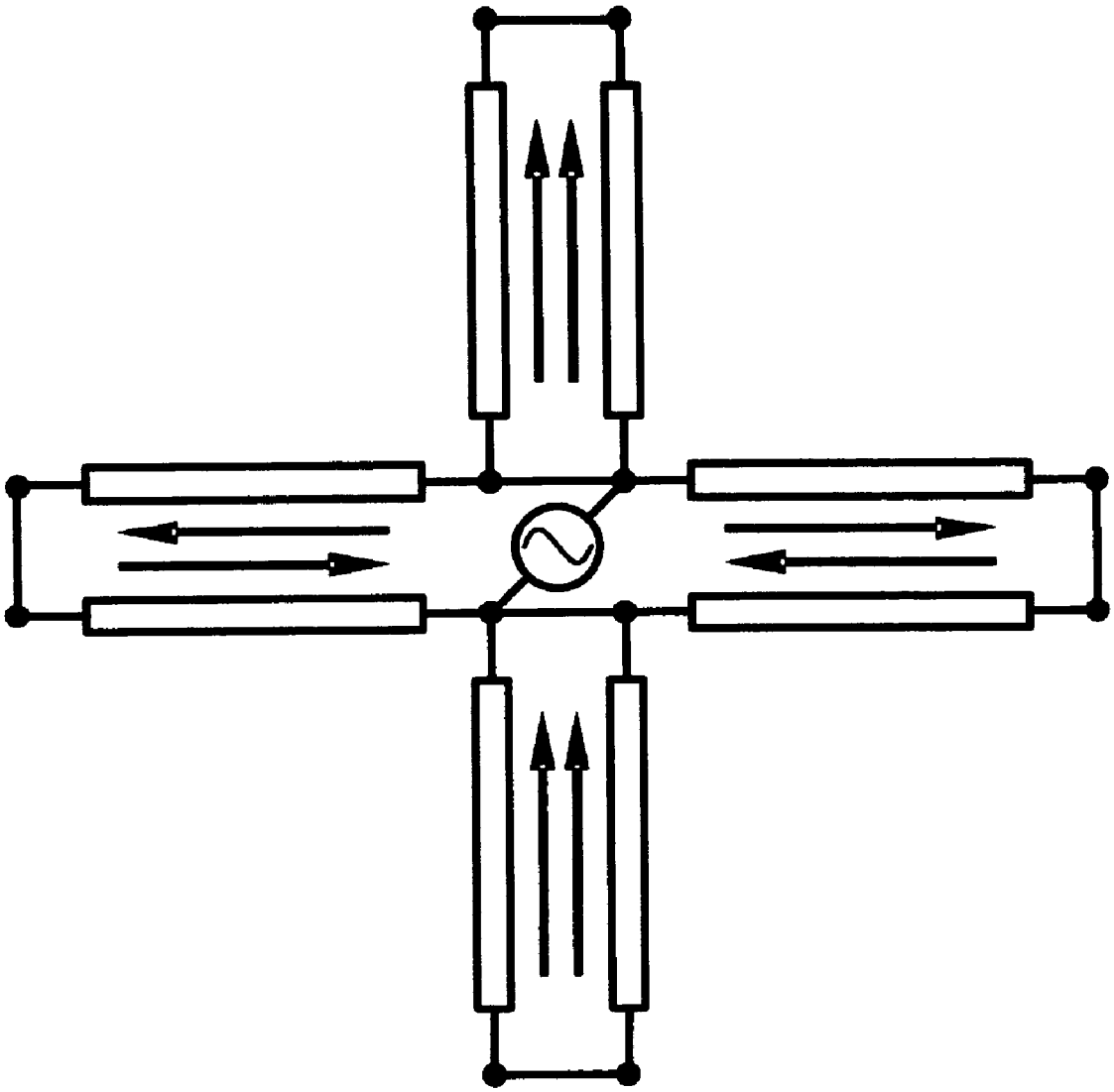
FIG. 5 illustrates the RF equivalent circuit when polarization is formed in a vertical direction according to the exemplary embodiment of the invention.

FIG. 5 illustrates the RF equivalent circuit when polarization is formed in a vertical direction according to the exemplary embodiment of the invention.

If positive bias voltage is applied to the switching network 250, all the PIN diodes are opened.

That is to say, the switches are connected as in FIG. 3, and in-phase linear polarization is formed in a vertical direction.

In this case, the vertical slotlines are short circuited at the intersection of the slotlines by the PIN diodes.

The horizontal slotlines are connected at the ends thereof by the PIN diodes, and act as the quarter wavelength short circuited stub. Furthermore, the horizontal slotlines are opposite in phase to each other and do not radiate.

A bias signal transmitted through a feed line as shown in FIG. 2, but may be divided by a decoupling inductor (L).

Figure 6:
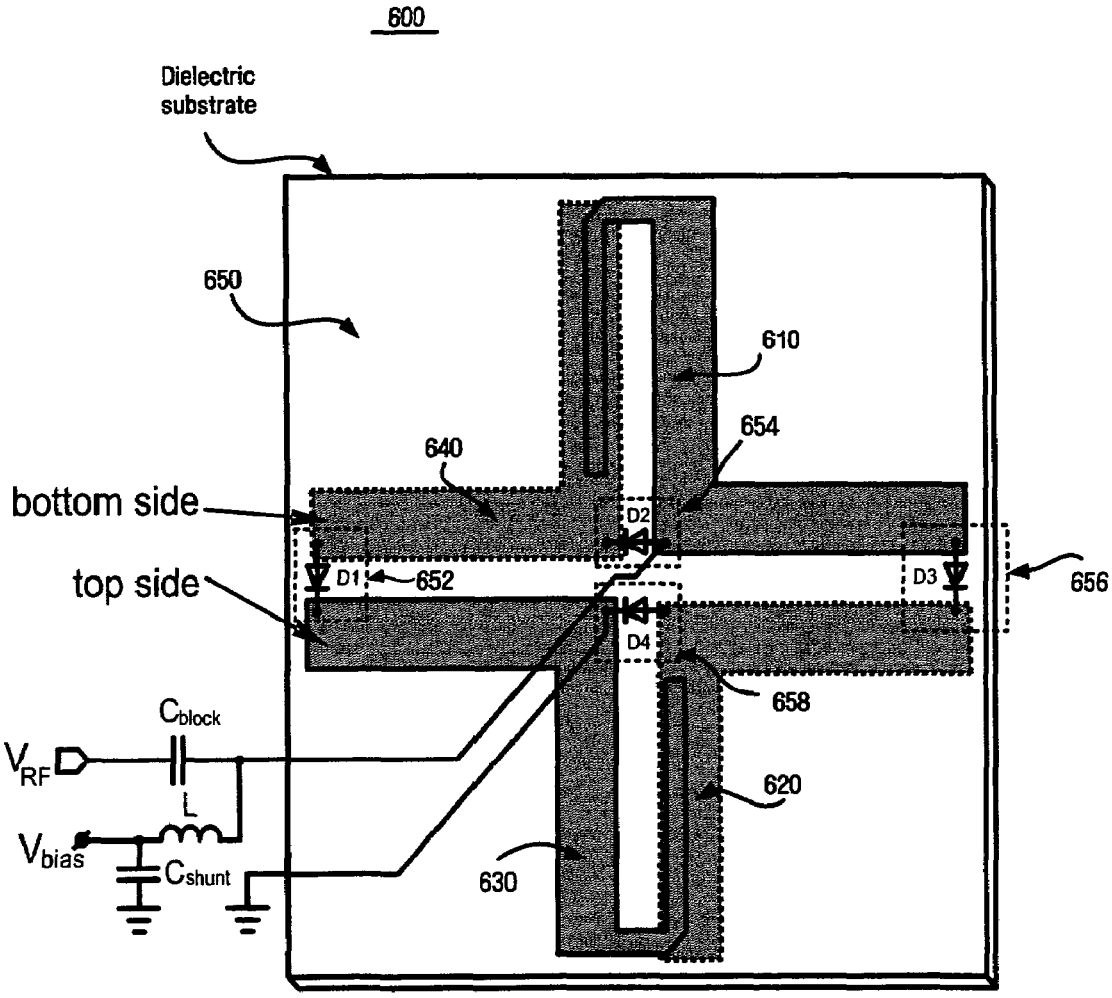
FIG. 6 illustrates a structure of a polarization diversity antenna system according to another exemplary embodiment of the invention.

FIG. 6 illustrates a structure of a polarization diversity antenna system according to another exemplary embodiment of the invention.

Referring to FIG. 6, in a polarization diversity antenna system 600, antenna elements 620 and 640 are printed on a bottom side of a dielectric substrate, and remaining antenna elements 610 and 630 are printed on a top side of the dielectric substrate.

Additionally, instead of the capacitors provided on the ends of the vertical slotlines as shown in FIG. 2, open ended quarter wavelength microstrip stubs are formed.

The microstrip stubs form a short circuit for an RF signal, and an open circuit for a low frequency bias current.

A bias signal transmitted through a feed line as shown in FIG. 6, but may be divided by a decoupling inductor (L).

With respect to the invention, FIGS. 2 and 6 mainly illustrate linear polarization, but the structure shown in FIGS. 2 and 6 may be transformed so as to provide circular polarization.

Although the present invention has been described in connection with the exemplary embodiments of the present invention, it will be apparent to those skilled in the art that various modifications and changes may be made thereto without departing from the scope and spirit of the invention. Therefore, it should be understood that the above embodiments are not limitative, but illustrative in all aspects.

The invention is advantageous in that a small polarization diversity antenna system having a simple structure is provided.

Furthermore, the invention is advantageous in that a switching network is controlled by unipolar bias voltage.

What is claimed is:

1. A polarization diversity antenna system, comprising:

antenna elements including first to fourth slotlines bent at right angles so that the second slotline is provided adjacent to the first slotline, the third slotline is diagonally opposite to the first slotline and provided adjacent to the second slotline, and the fourth slotline is provided adjacent to the third slotline and diagonally opposite to the second slotline; and a switching network in which coupling units are formed between ends of the horizontal slotlines and between ends of the vertical slotlines that are close to intersections of the vertical and horizontal slotlines to determine polarization.

2. The polarization diversity antenna system of claim 1, wherein the coupling units each comprise a PIN diode.

3. The polarization diversity antenna system of claim 1, wherein the first to fourth slotlines are disposed on the same side of a dielectric substrate.

4. The polarization diversity antenna system of claim 3, wherein the ends of the vertical slotlines are short circuited for an RF signal by a capacitor, and open circuited for a low frequency bias current.

5. The polarization diversity antenna system of claim 1, wherein the coupling units are disconnected and linear polarization is formed in a horizontal direction when bias voltage of zero volts is applied to the switching network.

6. The polarization diversity antenna system of claim 1, wherein the coupling units are connected and linear polarization is formed in a vertical direction when positive bias voltage is applied to the switching network.

7. The polarization diversity antenna system of claim 1, wherein the first and the third slotlines are disposed on a side of a dielectric substrate, and the second and the fourth slotlines are disposed on another side of the dielectric substrate.

8. The polarization diversity antenna system of claim 7, wherein microstrip stubs are disposed on ends of the vertical slotlines to provide a short circuit for an RF signal and to provide an open circuit for a low frequency bias current.

9. The polarization diversity antenna system of claim 8, wherein the microstrip stubs are an open ended quarter wavelength type.

10. A polarization diversity antenna system, comprising:

a dielectric substrate;

first and second antenna elements disposed on a first side of the dielectric substrate, wherein the first and second antenna elements are bent at right angles and the second antenna element is diagonally opposite to the first antenna element;

third and fourth antenna elements disposed on a second side of the dielectric substrate, wherein the third and fourth antenna elements are bent at right angles and the fourth antenna element is diagonally opposite to the third antenna element, wherein the third and fourth antenna elements disposed adjacent to the first and second antenna elements on an opposite side of the substrate; and a switching network in which coupling units are disposed between ends of the horizontal antenna elements and between ends of the vertical antenna elements that are close to intersections of the vertical and horizontal antenna elements to determine polarization.

* * * * *